US007556550B2

(12) United States Patent
Howard et al.

(10) Patent No.: US 7,556,550 B2
(45) Date of Patent: Jul. 7, 2009

(54) METHOD FOR PREVENTING ELECTRON EMISSION FROM DEFECTS IN A FIELD EMISSION DEVICE

(75) Inventors: Emmett M. Howard, Gilbert, AZ (US); Kenneth A. Dean, Phoenix, AZ (US); Dirk C. Jordan, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 685 days.

(21) Appl. No.: 11/292,408

(22) Filed: Nov. 30, 2005

(65) Prior Publication Data

US 2007/0123134 A1 May 31, 2007

(51) Int. Cl.
*H01J 9/00* (2006.01)

(52) U.S. Cl. ..... 445/24; 313/495

(58) Field of Classification Search ..... 313/495–497; 445/24–25

See application file for complete search history.

(56) References Cited

U.S. PATENT DOCUMENTS 5,442,193 A * 8/1995 Jaskie et al. ..... 257/10
5,457,355 A 10/1995 Fleming et al.
5,719,406 A 2/1998 Cisneros et al.
5,787,337 A 7/1998 Matsuno et al.
5,844,251 A * 12/1998 MacDonald et al. ..... 257/10
6,858,455 B2 * 2/2005 Guillom et al. ..... 438/20
2002/0125805 A1 9/2002 Hsu
2004/0027052 A1 * 2/2004 Choi et al. ..... 313/495

OTHER PUBLICATIONS

International Search Report PCT/US06/60669 dated Sep. 28, 2007.

* cited by examiner

*Primary Examiner*—Nimeshkumar D. Patel
*Assistant Examiner*—Anne M Hines

(57) ABSTRACT

A method is provided for preventing electron emission from a sidewall (34) of a gate electrode (20) and the edge (28) of the gate electrode stack of a field emission device (10), the gate electrode (20) having a surface (24) distally disposed from an anode (40) and a side (26) proximate to emission electrodes (38). The method comprises growing dielectric material (22) over the surface (24) and side (26) of the gate electrode (20), and performing an anisotropic etch (32) normal to the surface (24) to remove the dielectric material (22) from the surface (24) and leaving at least a portion of the dielectric material (22) on the side (26) of the gate electrode (20) and edge (28) of the gate electrode stack.

18 Claims, 2 Drawing Sheets

METHOD FOR PREVENTING ELECTRON EMISSION FROM DEFECTS IN A FIELD EMISSION DEVICE

FIELD OF THE INVENTION

The present invention generally relates to field emission devices and more particularly to a method of preventing electron emission and leakage from a sidewall of a gate electrode and the edge of the gate electrode stack of a field emission device.

BACKGROUND OF THE INVENTION

Field emission displays include an anode and a cathode structure. The cathode is configured into a matrix of rows and columns, such that a given pixel can be individually addressed. Addressing is accomplished by placing a positive voltage on one row at a time. During the row activation time, data is sent in parallel to each pixel in the selected row by way of a negative voltage applied to the column connections, while the anode is held at a high positive voltage. The voltage differential between the addressed cathode pixels and the anode accelerates the emitted electrons toward the anode.

Field effect devices typically comprise a metal cathode on a substrate, with carbon nanotubes grown on the cathode. A metal catalyst may be positioned between the cathode and the carbon nanotubes for facilitating carbon nanotube growth. A gate electrode is positioned between an anode and the tops of the carbon nanotubes for controlling electron emission from the carbon nanotubes. Electrons flow from the metal cathode through the metal catalyst if present, and out the carbon nanotubes to the anode spaced therefrom.

Color field emission display devices typically include a cathodoluminescent material underlying an electrically conductive anode. The anode resides on an optically transparent frontplate and is positioned in parallel relationship to an electrically conductive cathode. The cathode is typically attached to a glass backplate and a two dimensional array of field emission sites is disposed on the cathode. The anode is divided into a plurality of pixels and each pixel is divided into three subpixels. Each subpixel is formed by a phosphor corresponding to a different one of the three primary colors, for example, red, green, and blue. Correspondingly, the electron emission sites on the cathode are grouped into pixels and subpixels, where each emitter subpixel is aligned with a red, green, or blue subpixel on the anode. By individually activating each subpixel, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

However, vacuum field emission devices are commonly plagued with electrons being emitted (a leakage current) from various types of unintended emission sites. These spurious emission sites are often formed as an unintended consequence of the fabrication process. Unintended emitters can result from anomalously sharp edges of metal electrodes; conductive particles in high field regions, patterning defects, lifting metal, emitters (such as nanotubes) deposited in the wrong place, etc. In addition, many types of field emission cathode structures have a gate electrode stack. This feature typically incorporates a metal gate electrode deposited on top of an insulator, which is then deposited on or very near a cathode electrode. The edges of these features are typically exposed at a sidewall feature. In some cases the wall in vertical, in some cases the 'wall' is a gentle slope, and in some cases, the wall is a concave feature. Regardless of the exact structure of the wall, the 'wall' feature is a typical location for unintended emission because it is a high electric field region.

An example of a type of defect that causes unintended emission is a sharp point on the sidewall of the gate electrode metal. This defect can occur at the edge of a gate electrode stack, but it can also occur at any edge of the gate metal. This defect is typically caused by a wet etch in the manufacturing process, but could also be caused by lithography, stamping, screen printing, or any other process providing gate anomalies. In the case where the anode field alone is sufficient to initiate electron emission, this undesired emission site is commonly referred to as an anode leader. The intensity of electron emission increases with the applied anode voltage. Furthermore, when field emission devices are in their 'off' state, the gate electrode potential is driven lower than the cathode electrode potential, creating a reverse bias condition. In this case, the cathode electrode itself provides the field which pulls electrons off the gate metal asperity. This emission site is often called a reverse bias leader. Both cases lead to image defects wherein the sub-pixels are always illuminated, resulting in loss of contrast and brightness, and the inability to operate the device at optimal conditions.

Another type of unintended emission results from defects at the edge of the gate electrode stack. Conductive particles can be defects at the base of the gate electrode stack. They might result from particles present in the process line, patterning defects, re-deposited material during wet processing, or emitter features (such as nanotubes) erroneously deposited in the wrong place. The base of the gate electrode stack forms a junction between a conductor, an insulator, and vacuum which is commonly termed a triple point. This junction creates an enhanced electric field at the conductive defect, and under the influence of the gate potential and/or the anode potential, the conductive defect can emit electrons. These electrons typically cascade up the sidewall, producing an unwanted leakage current between the anode and the cathode, and often produce emitted electrons at the anode. These defects typically are not ballasted by series resistance in the field emission structure so they contribute to excessive (and non-uniform) light at the sub-pixel. They also become hot and produce a run-away current condition that ends in the explosion of the defect, and sometimes a device shorting defect.

Another defect, residual conductive material on the gate electrode stack sidewall, can also produce leakage current between the gate and the cathode electrodes. The residual conductive material allows some electrons to pass between the gate and cathode electrodes along the insulator surface (surface hopping of emitted electrons). With higher bias between the electrodes, more current flows. Sufficient current flow causes the region to heat up and the current to increase in a positive feedback condition that often ends in an explosion of the sidewall region. This may produce a device shorting defect.

Accordingly, it is desirable to provide a method of preventing electron emission from various defects at the sidewall of a gate electrode and the edges of the gate electrode stack of a field emission device. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An apparatus and method is provided for preventing electron emission from a sidewall of a gate electrode and the edge of the gate electrode stack of a field emission device, the gate electrode having a surface distally disposed from an anode and a side proximate to emission electrodes. The method comprises growing dielectric material over the surface and side of the gate electrode and gate electrode stack, and performing an anisotropic etch normal to the surface to remove the dielectric material from the surface and leaving at least a portion of the dielectric material on the side of the gate electrode and edge of the gate electrode stack.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In order to eliminate electron emission from sharp points on the side of a gate electrode, particles at the bottom of the edge of the gate electrode stack, residual conductive material on the insulator surface at the edge of the gate metal stack, and other defects occurring at the edge of the gate metal stack, of a field emission display, a dielectric material is deposited over the gate electrode including its side. An anisotropic etch is then performed to remove the dielectric material from over the gate electrode, leaving a side-wall layer of the dielectric material that presents a smoother surface on all vertical surfaces. This smoother surface is a good insulator.

Figure 1:
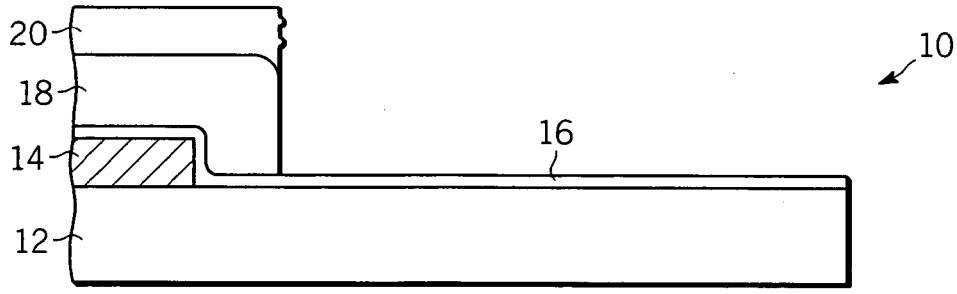
FIG. 1 is a partial cutaway side view of a known field emission display.
Figure 2:
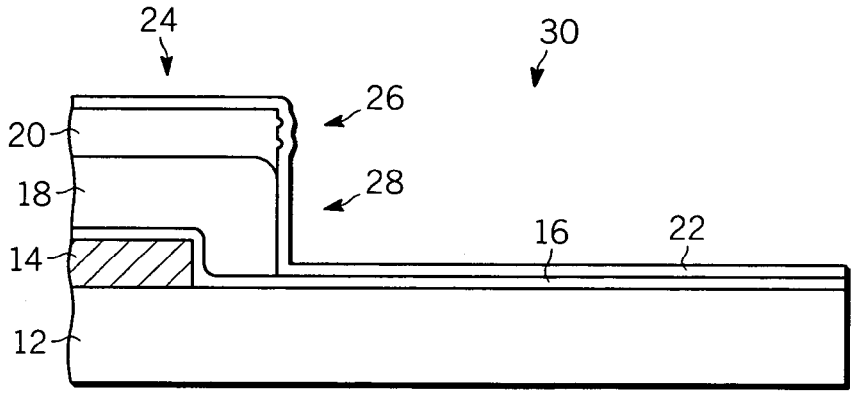
FIG. 2 is a partial cutaway side view illustrating a first step of the exemplary embodiment of the present invention.

Referring to FIG. 1, a previously known process for forming a cathode 10, which may be used with the present invention, include depositing a cathode metal 14 on a substrate 12. The substrate 12 comprises silicon; however, alternate materials, for example, silicon, glass, ceramic, metal, a semiconductor material, or an organic material are anticipated by this disclosure. Substrate 12 can include control electronics or other circuitry, which are not shown in this embodiment for simplicity. The cathode metal 14 is molybdenum, but may comprise any metal. A ballast resistor layer 16 of a semiconductor material is deposited over the cathode metal 14 and the substrate 12. A conformal layer (e.g., dielectric layer 18) is deposited over the ballast resistor above the cathode metal 14 to provide spacing for the gate electrode 20. The gate electrode 20 comprises a conductor, for example, chrome-copper-chrome layers. The above layers and materials are formed by standard thin or thick film techniques known in the industry. The combination of the gate metal layer 20, dielectric layer 18, ballast resistor layer 16 and cathode metal 14 may be referred to as a gate electrode stack. The side 26, 28 of the gate electrode stack preferably has an angle greater than 80° (may be concave), and more preferably between 80° and 100°, to the top of the substrate 12.

In accordance with an exemplary embodiment of the present invention, a dielectric material 22 is deposited over the surface 24 and the side 26 of the gate electrode 20, as well as the side 28 of the dielectric layer 18 and over the ballast resistor 16 in the well 30 (a blanket deposition not requiring a mask). The dielectric material 22 is deposited using a low pressure technique such as PECVD resulting in a uniform thickness in the range of 100 Angstroms to 10,000 Angstroms for example. Other techniques such as sputtering may be used, but the thickness may not be as uniform. The dielectric material preferably comprises silicon oxide or silicon nitride, but may comprise any dielectric material including at least silicon dioxide, silicon oxynitride, and a spin-on glass.

Figure 3:
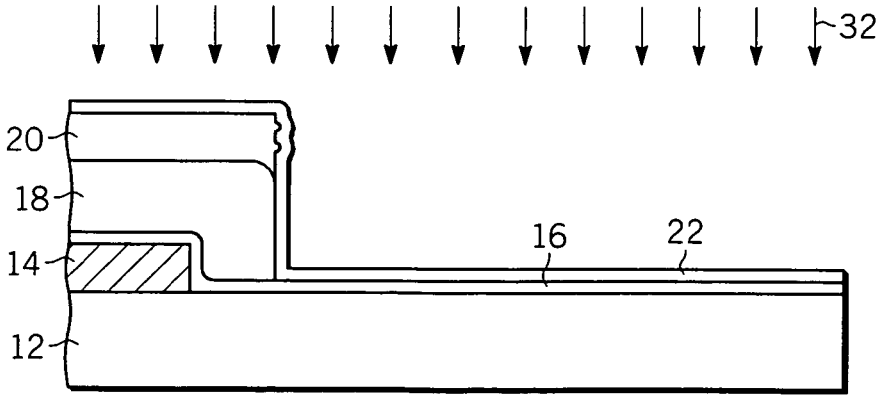
FIG. 3 is a partial cutaway side view illustrating a second step of the exemplary embodiment of the present invention.
Figure 4:
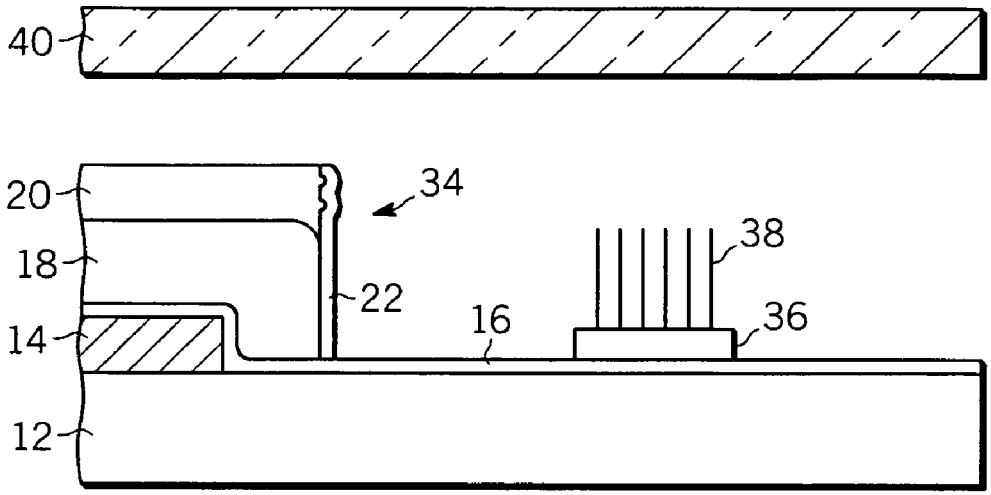
FIG. 4 is a partial cutaway side view of an exemplary embodiment of the present invention.

In a preferred embodiment, the anisotropic, or directional, etch is a dry etch represented by the arrows 32 in FIG. 3 is then performed normal, or perpendicular, to the surface 24 of the gate electrode 20, resulting in the removal of the dielectric material 22 from the surface 24 and from the ballast resistor 16. The dry etch preferably comprises chlorine, but may comprise any material used in the industry as a dry etch. The dry etch, for example, may be applied at, for example, 350 W RF, 70 mTorr, 20 sccm Ar, 7 sccm $CHF_3$, with etch pressure and Ar to $CHF_3$ ratio being critical to selectivity of planar etching to sidewall etching. The RIE parameters produce a polymer which blocks sidewall etch by forming a polymer on the sidewall at a rate faster than it etches the sidewall polymer. The process parameters maintain a planar surface etch rate higher than the polymer build up rate making the etch anisotropic. A sidewall 34 of the dielectric material remains after the dry etch on the side 26 of the gate electrode 20 (as well on the side 28 of the dielectric layer 18) due to the physical property of a dry etch removing a much larger (ten times for example) amount of the dielectric material 22 when impacted normal to the surface as opposed to vertically. Preferably, 50% to 80% of the thickness of the dielectric material 22 remains as the sidewall 34 after the dry etch. The sidewall 34 must be thick enough to lower the electric field potential of the gate electrode 20. Alternatively, a wet etch may be used, such as when the conformal layer 22 comprises a vertical grain structure or a multi-layer stack.

In accordance with known methods, the catalyst 36 is deposited on the ballast resistor 16. The catalyst 36 preferably comprises nickel, but could comprise any one of a number of other materials including cobalt, iron, and a transition metal or oxides and alloys thereof. Additionally, the catalyst 36 may be formed by any process known in the industry, e.g., evaporation, sputtering, precipitation, wet chemical impregnation, incipient wetness impregnation, adsorption, ion exchange in aqueous medium or solid state, before having the present invention applied thereto. One preferred method would be to form a relatively smooth film and subsequently etching the film to provide a rougher surface.

Carbon nanotubes 38 are then grown from the catalyst 36 in a manner known to those skilled in the art. Although only a few carbon nanotubes 38 are shown, those skilled in the art understand that any number of carbon nanotubes 38 could be formed. It should be understood that any nanotube or electron emitter having a height to radius ratio of greater than 100, for example, would function equally well with some embodiments of the present invention.

Anode plate 40 includes a solid, transparent material, for example, glass. Typically, a black matrix material (not shown) is disposed on the anode plate to define openings (not shown) representing pixels and sub-pixels containing a phosphor material (not shown) in a manner known to those in the industry. The phosphor material is cathodoluminescent and emits light upon activation by electrons, which are emitted by carbon nanotubes 38.

As used herein, carbon nanotubes include any elongated carbon structure. Preferably, the carbon nanotubes 38 are grown on a line from the cathode 10 (more particularly the catalyst 36 in this exemplary embodiment) towards the anode 40.

The sidewall spacer 34 of dielectric material 22 isolates the gate electrode 20 from the cathode 14 (e.g., through the ballast resistor 16 and catalyst material 36). Since the sidewall spacer 34 is positioned in a non-active area of the field emission device 10, it does not negatively impact the display from the anode 40.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A method for preventing electron emission from defects along the side of a gate electrode stack of a field emission device, comprising:

growing a conformal layer comprising a vertical grain structure over the gate electrode stack and the side of the gate electrode stack; and performing an anisotropic etch of the conformal layer which leaves at least a portion of the conformal layer on the side of the gate electrode stack.

2. The method of claim 1 wherein the side of the gate electrode stack has an angle of greater than 80 degrees to a substrate.

3. The method of claim 1 wherein the conformal layer comprises one of silicon dioxide, silicon nitride, and spin-on glass.

4. The method of claim 1 wherein the anisotropic etch is a dry etch.

5. The method of claim 1 wherein the anisotropic etch is a wet etch through the vertical grain structure.

6. The method of claim 1 wherein the conformal layer comprises a multi-layer stack.

7. The method of claim 6 wherein the anisotropic etch is a wet etch through the multi-layer stack.

8. A method for preventing electron emission from a defect on the side of a gate electrode of a field emission device, the gate electrode having a surface distally disposed from an anode and a side proximate to emission electrodes, comprising:

growing a dielectric layer comprising a vertical grain structure over the surface and side of the gate electrode; and performing an anisotropic etch normal to the surface to remove the dielectric layer from the surface and leaving at least a portion of the dielectric layer on the side.

9. The method of claim 8 wherein the performing step comprises performing a dry etch of at least $CHF_3$.

10. The method of claim 8 wherein the performing step comprises performing a dry etch resulting in a dielectric layer on the side having a thickness sufficient to lower an electric field potential of the gate electrode.

11. The method of claim 8 wherein the growing step comprises growing a dielectric layer having a thickness in the range or 100 Angstroms to 10,000 Angstroms.

12. The method of claim 8 wherein the side of the gate electrode has an angle of greater than 80 degrees to a substrate.

13. The method of claim 8 wherein the dielectric layer comprises one of silicon dioxide, silicon nitride, and spin-on glass.

14. A method for preventing electron emission from a sidewall of a gate electrode of a field emission display, the field emission display including a cathode formed overlying a first portion of a substrate, a dielectric layer overlying the cathode, and a gate electrode overlying the dielectric layer, and emission electrodes overlying a second portion of the substrate and in electrical contact with the cathode, wherein the gate electrode has a surface distally disposed from an anode and a side proximate to emission electrodes, the method comprising:

growing dielectric material comprising a vertical grain structure over the surface and the side; and performing an anisotropic etch normal to the surface to remove the dielectric material from the surface and leaving at least a portion of the dielectric material on the side.

15. The method of claim 14 wherein the performing step comprises performing a dry etch of at least $CHF_3$.

16. The method of claim 14 wherein the performing step comprises performing a dry etch resulting in a dielectric layer on the side having a thickness sufficient to lower an electric field potential of the gate electrode.

17. The method of claim 14 wherein the growing step comprises growing a dielectric layer having a thickness in the range or 100 Angstroms to 10,000 Angstroms.

18. The method of claim 14 wherein the side of the gate electrode has an angle of greater than 80 degrees to a substrate.

* * * * *